US005709093A

United States Patent [19]

Cerri et al.

[11] Patent Number: 5,709,093

[45] Date of Patent: Jan. 20, 1998

[54] PROCESS FOR MINIMIZING COMPOSITIONAL CHANGES

[75] Inventors: Gustavo Cerri, Boonton; Maurice William Hunt, Wenonah, both of N.J.

[73] Assignee: AlliedSignal Inc., Morristown, N.J.

[21] Appl. No.: 671,440

[22] Filed: Jun. 27, 1996

[51] Int. Cl.[6] ..... F25B 41/00

[52] U.S. Cl. ..... 62/114; 62/77

[58] Field of Search ..... 62/77, 114, 149, 62/292, 502, 50.1, 48.1; 252/67, 69

[56] References Cited

U.S. PATENT DOCUMENTS 4,700,549 10/1987 Biagini ..... 62/292

*Primary Examiner*—John M. Sollecito

*Attorney, Agent, or Firm*—Lois A. Gianneschi; Jay P. Friedenson

[57] ABSTRACT

A process for minimizing the compositional changes that occur in a non-azeotropic composition during the withdrawal of an amount of the composition from a storage vessel. The process of the invention provides for the minimization of compositional changes by cooling the non-azeotropic composition.

10 Claims, No Drawings

PROCESS FOR MINIMIZING COMPOSITIONAL CHANGES

FIELD OF THE INVENTION

The invention relates to a process for minimizing the compositional changes that occur in a non-azeotropic composition that is a blend of at least two components during the withdrawal of an mount of the composition from a vessel. More particularly, the invention provides for the minimization of compositional changes by cooling the non-azeotropic composition.

BACKGROUND OF THE INVENTION

Fluorocarbon-based fluids are used by industry in a variety of applications including, without limitation, as refrigerants, blowing agents, heat transfer fluids, gaseous dielectrics, aerosol propellants, and fire extinguishants. Of particular interest are fluorocarbon-based fluids that are environmentally acceptable substitutes for the presently used, ozone-depleting chlorofluorocarbons.

Among the fluorocarbon-based compositions of interest are non-azeotropic compositions that are blends of at least two components. These compositions present potential problems in that they may exhibit compositional changes as amounts of the composition are withdrawn from a vessel containing the composition. These compositional changes are attributable to the difference in boiling points of the components of the composition. As amounts of the composition are withdrawn from the vessel, the resultant vapor space within the vessel preferentially is filled by the more volatile component or components of the non-azeotropic composition. As a result, the liquid composition remaining in the vessel is depleted of the lower boiling, and enriched in the higher boiling, components. Therefore, the liquid composition within the vessel may be outside of its specified tolerances at some point during the withdrawal of an amount of the composition from the vessel.

DESCRIPTION OF THE INVENTION AND THE PREFERRED EMBODIMENTS

The invention provides a method for minimizing the compositional changes in a non-azeotropic composition comprising a blend of at least two components during withdrawal of an amount of the composition from a vessel. More specifically, the invention provides a process for withdrawing an amount of a non-azeotropic composition from a vessel containing the composition while maintaining the composition's tolerances comprising the step of cooling the composition.

For purposes of the invention, by non-azeotropic composition is meant a composition the components of which either do not form an azeotropic composition or a composition the components of which can form an azeotropic composition but in which the components are not present in their azeotropic weight percent ratios. Also for purposes of the invention, by tolerances is meant compositional variabilities in component amounts within which compositional performance variations are not significant. Such compositional performance variabilities, if outside of set tolerances, may deleteriously affect a composition's performance in a specified use as well as its flammability, toxicity, and reliability. Tolerances for non-azeotropic compositions are set by industry and known, or readily determined, by those ordinarily skilled in the art.

The present invention provides a simple and effective method for solving the problem of compositional changes that occur when an amount of a non-azeotropic composition is withdrawn from a vessel containing the composition. The withdrawal of the composition may be due to an intentional discharge of an amount of the composition from the vessel or a leakage from the vessel. Withdrawal of any amount of the non-azeotropic composition produces additional vapor space within the vessel that preferentially becomes filled with the more volatile of the components of the composition. The liquid composition in the vessel, thus, becomes depleted of the lower boiling component. The compositional changes, at some point, may become large enough that the composition's tolerances are exceeded.

Compositions useful in the practice of the invention are non-azeotropic liquid blends of at least two components. Such compositions include compositions in which the components are fluorocarbons, hydrofluorocarbons, hydrochlorofluorocarbons, chlorofluorocarbons, hydrocarbons, or mixtures thereof. Exemplary compositions include, without limitation: R-407C which is a mixture of difluoromethane ("R-32"), pentafluoroethane ("R-125") and 1,1,1,2-tetrafluoroethane ("R-134a"); R-401A which is a mixture of chlorodifluoromethane ("R-22"), 1-chloro-1,2,2,2-tetrafluoroethane ("R-124") and 1,1-difluoroethane ("R-152a"); and R-402A or B which are mixtures of R-125, propane ("R-290") and R-22. The invention finds particular utility for compositions which have a very high vapor pressure and/or have a large difference in boiling points between the components, such as R-407C.

In the process of the invention, the non-azeotropic composition is cooled prior to withdrawal of an amount of the composition from a vessel containing the composition. Alternatively, the composition may be cooled before and during withdrawal of an amount of the composition from the vessel.

The non-azeotropic compositions used in the invention are mixed and/or stored and transported in large vessels from which portions of the composition are charged out in small increments .for use or sale. In the process of the invention, the composition is cooled to a temperature and for a time that maintains the composition's tolerances during the withdrawal of the desired amount of the composition from a vessel containing the composition. The temperature to which the composition is cooled will be selected based on a consideration of the vapor pressure and relative volatility of the composition's components, factors that are readily determinable by one ordinarily skilled in the art. In general, the lower the temperature, the greater the amount of the composition that can be transferred out of the vessel containing the composition before the composition's tolerances are exceeded.

Any convenient means for cooling the composition may be used. For example, a pump may be used to circulate the composition through a heat exchanger supplied with cold fluid generated by an external cooling unit. In another embodiment, a compressor and heat exchanger are installed to directly compress the components in the vapor space of the vessel. The compressed vapor is then condensed and allowed to flow back as a liquid into the vessel. The pressure in the vessel thus is reduced to below the vapor pressure of the blend at its starting temperature, lowering the temperature of the composition to its saturation temperature at the new lower pressure. In yet another embodiment, a cooling coil may be installed either internally or externally on the vessel and a cooling fluid circulated through the coil. In a further embodiment, small vessels containing the composition simply are cooled by placing the vessel in a refrigerator, or similar cooling apparatus, prior to withdrawal of an amount of the non-azeotropic composition from the vessel.

The invention will be clarified further by the following examples that are meant to be purely exemplary.

EXAMPLES

Example 1

The interaction coefficients for the components of R-407C were experimentally determined and used in the Carnahan-Starling-DeSantis equation to predict the composition of a blend remaining in a vessel from which an amount of R-407C had been withdrawn at 80° and 20° F. The results are shown on Table 1.

TABLE 1

| Amount | Liquid Composition remaining in vessel; at 8° F. | | | Liquid Composition remaining in vessel; at 20° F. | | |
|---|---|---|---|---|---|---|
| withdrawn | R-134a | R-125 | R-32 | R-134a | R-125 | R-32 |
| 0% | 52.00 | 25.00 | 23.00 | 52.00 | 25.00 | 23.00 |
| 10% | 52.16 | 24.93 | 22.91 | 52.07 | 24.97 | 22.96 |
| 20% | 52.24 | 24.90 | 22.86 | 52.10 | 24.96 | 22.94 |
| 30% | 52.34 | 24.86 | 22.80 | 52.14 | 24.94 | 22.92 |
| 40% | 52.46 | 24.81 | 22.73 | 52.19 | 24.92 | 22.89 |
| 50% | 52.59 | 24.75 | 22.66 | 52.25 | 24.89 | 22.86 |
| 60% | 52.76 | 24.68 | 22.56 | 52.31 | 24.86 | 22.83 |
| 70% | 52.97 | 24.59 | 22.44 | 52.40 | 24.82 | 22.78 |
| 80% | 53.26 | 24.46 | 22.28 | 52.52 | 24.77 | 22.71 |
| 90% | 53.78 | 24.23 | 21.99 | 52.74 | 24.67 | 22.59 |

As shown by the data on Table 1, R-32, the most volatile component is depleted out of the liquid remaining in the vessel and the mount of the least volatile component, R-134a, increases. This change in composition is much less at 20° F. than at 80° F. At 20° F., given a tolerance of ±0.5%, approximately 78% of the starting R-407C can be withdrawn before one of the components changes by more than 0.5%. At 80° F., only 43% can be withdrawn before this change occurs.

Example 2

Approximately 10,000 gallons of R-407C in a 12,000 gallon insulated storage vessel at a starting temperature of 70° to 100° F. are cooled to less than 15° F. prior to packaging the contents into 25 lb and 115 lb cylinders. The R-407C is cooled by pumping the R-407C from the storage vessel at about 200 gallon per minute through tubes in a shell and tube heat exchanger supplied with a cooling fluid at about 4° F. on the shell side. The cooled R-407C blend is returned back to the storage vessel and when the entire contents of the storage vessel are below 15° F., the R-407C blend is charged out to fill the cylinders. The R-407C stays within tolerances throughout the transfer of the composition to the cylinders.

Example 3

Approximately 10,000 gallons of R-407C in a 12,000 gallon insulated storage vessel at a starting temperature of 70° to 100° F. are cooled to less than 15° F. prior to packaging the contents into 25 lb and 115 lb cylinders. The R-407C is cooled by compressing the vapor from the vapor space in the storage vessel to about 240 psig using an oil-free compressor. The discharge of the compressor is condensed in a heat exchanger as in Example 2 except that the cooling temperature is about 90° F. The R-407C stays within tolerances throughout the transfer of the composition to the cylinders.

Example 4

Approximately 10,000 gallons of R-401A in a 12,000 gallon insulated storage vessel at a starting temperature of 70° to 100° F. are cooled to less than 10° F. prior to packaging the contents into 25 lb and 115 lb cylinders. The R-401A is cooled according to the procedure of Example 3 except that ambient air is used as the cooling medium and the discharge pressure is approximately 400 psig. The condensed 401A is returned to the storage vessel through a let-down valve that reduces the pressure to that of the storage vessel. The 401A is cooled to about 10° F. by reducing the pressure to 18 psig. The R-401A stays within tolerances throughout the transfer of the composition to the cylinders.

Example 5

Approximately 10,000 gallons of R-407C in a 12,000 gallon insulated storage vessel at a starting temperature of 70° to 100° F. are cooled to less than 15° F. prior to packaging the contents into 25 lb and 115 lb cylinders. The R-407C is cooled by pumping the R-407C from the storage vessel which is equipped with an internal coil of U-tubes located in the bottom of the vessel so as to be immersed in the R-407C. A cooling fluid is supplied at about 4° F. and is circulated through the U-tubes to cool the tank contents from the starting temperature to less than 15° F. The R-407C stays within tolerances throughout the transfer of the composition to the cylinders.

Example 6

A 25 lb jug of R-407C is stored in a refrigerator set to cool the jug to about 15° F. After the jug contents have been cooled, the jug is transported to a work site and stored in an insulated container to maintain the cooled state of the contents. The contents are used in multiple air conditioner unit recharges with the R-407C staying within its tolerances throughout.

What is claimed is:

1. A process for minimizing compositional changes of a non-azeotropic composition during withdrawal of an amount of said non-azeotropic composition from a vessel containing the composition, which process comprises the step of cooling the non-azeotropic composition to a temperature sufficient to maintain the non-azeotropic composition's tolerances during the withdrawal of the amount of the composition from the vessel.

2. The process of claim 1 wherein the non-azeotropic composition is cooled prior to withdrawal of the amount of the composition from the vessel.

3. The process of claim 1 wherein the non-azeotropic composition is cooled prior to and during the withdrawal of the amount of the composition from the vessel.

4. The process of claim 1 wherein the non-azeotropic composition is comprised of a mixture of difluoromethane, pentafluoroethane, and 1,1,1,2-tetrafluoroethane.

5. The process of claim 1 wherein the non-azeotropic composition is comprised of a mixture of chlorodifluoromethane, 1-chloro-1,2,2,2-tetrafluoroethane and 1,1-difluoroethane.

6. The process of claim 1 wherein the non-azeotropic composition is comprised of a mixture of pentafluoroethane, propane and chlorodifluoromethane.

7. The process of claim 1 wherein the cooling takes place by circulating the non-azeotropic composition through a heat exchanger supplied with a cooled fluid generated by a cooling unit external to the vessel.

8. The process of claim 1 wherein the cooling takes place by compressing a vapor in the vessel, condensing the compressed vapor in a heat exchanger, and returning the condensed vapor to the vessel.

9. The process of claim 1 wherein the cooling takes place by cooling the non-azeotropic composition with a heat exchanger coil.

10. The process of claim 1 wherein the cooling takes place by cooling the vessel in a refrigerator.

* * * * *

UNITED STATES PATENT AND TRADEMARK OFFICE

CERTIFICATE OF CORRECTION

PATENT NO : 5,709,093
DATED : January 20, 1998
INVENTOR(S) : Cerri et al.

It is certified that error appears in the above-identified patent and that said Letters Patent is hereby corrected as shown below:

Column 1, line 8, delete "mount" and substitute therefor -- amount --.

Column 3, line 15, delete "8°F." and substitute therefor -- 80°F. --.

Column 3, line 30, delete "mount" and substitute therefor -- amount --.

Signed and Sealed this

Twenty-ninth Day of February, 2000

*Attest:*

Q. TODD DICKINSON

*Attesting Officer*

*Commissioner of Patents and Trademarks*